US011066800B2

(12) United States Patent
Matlock et al.

(10) Patent No.: US 11,066,800 B2
(45) Date of Patent: Jul. 20, 2021

(54) OFFSHORE INSTALLATION

(71) Applicant: INNOGY SE, Essen (DE)

(72) Inventors: Benjamin Matlock, Hamburg (DE); Bernadette Zipfel, Hamburg (DE)

(73) Assignee: INNOGY SE, Essen (DE)

( * ) Notice: Subject to any disclaimer, the term of this patent is extended or adjusted under 35 U.S.C. 154(b) by 0 days.

(21) Appl. No.: 16/619,910

(22) PCT Filed: May 4, 2018

(86) PCT No.: PCT/EP2018/061548

§ 371 (c)(1),
(2) Date: Dec. 5, 2019

(87) PCT Pub. No.: WO2018/224223

PCT Pub. Date: Dec. 13, 2018

(65) Prior Publication Data

US 2020/0378082 A1 Dec. 3, 2020

(30) Foreign Application Priority Data

Jun. 6, 2017 (DE) ..... 102017112373.3

(51) Int. Cl.
*E02B 17/02* (2006.01)
*E02B 17/00* (2006.01)
(Continued)

(52) U.S. Cl.
CPC ..... *E02B 17/0026* (2013.01); *C23F 13/005* (2013.01); *E02D 27/12* (2013.01);
(Continued)

(58) Field of Classification Search
CPC ..... E02B 17/0026; E02B 2017/0065; E02B 2017/0043; E02B 2017/0095
See application file for complete search history.

(56) References Cited

U.S. PATENT DOCUMENTS 4,038,168 A * 7/1977 Higuchi ..... C23F 13/02 204/196.15
4,415,293 A 11/1983 Engel et al.
(Continued)

FOREIGN PATENT DOCUMENTS

EP 3064648 A1 9/2016
EP 3483342 A1 * 5/2019 ..... B66C 1/108
(Continued)

OTHER PUBLICATIONS

Internatonal Preliminary Report on Patentability dated May 17, 2019 From PCT/EP2018/061548, Filed May 4, 2018 with English Translation and untranslated versions, along with english translation of amended claims.

(Continued)

*Primary Examiner* — Frederick L Lagman
(74) *Attorney, Agent, or Firm* — Wiley Rein LLP

(57) ABSTRACT

The invention relates to an offshore installation, comprising an underwater foundation structure, a construction placed onto the foundation structure, a docking device for a boat, and a device for cathodic corrosion protection for the underwater foundation structure, said device having at least two anodes (2), which are arranged at a distance from each other and are each fastened to a beam (4) or a support of the foundation structure, the extension arms or the supports being connected directly to the foundation structure below the waterline.

9 Claims, 2 Drawing Sheets

(51) Int. Cl.
*C23F 13/00* (2006.01)
*E02D 27/12* (2006.01)

(52) U.S. Cl.
CPC ... *C23F 2213/31* (2013.01); *E02B 2017/0043* (2013.01); *E02B 2017/0065* (2013.01); *E02B 2017/0095* (2013.01)

(56) References Cited

U.S. PATENT DOCUMENTS 4,484,839 A * 11/1984 Nandlal ..... E02B 17/0026 204/196.18
4,629,366 A 12/1986 Rutherford et al.
4,659,255 A * 4/1987 Shiraishi ..... C23F 13/02 405/211
5,652,068 A * 7/1997 Shuster ..... H01M 12/06 429/407
5,712,061 A * 1/1998 Spak ..... H01M 2/06 429/208
2008/0199258 A1* 8/2008 Spears ..... C23F 13/18 405/211.1
2011/0006538 A1* 1/2011 Fischer ..... F03D 13/25 290/55
2012/0282035 A1 11/2012 Ebert

FOREIGN PATENT DOCUMENTS

GB 2473058 A * 3/2011 ..... E02B 17/00
KR 101510539 B1 4/2015
WO WO-2019025316 A1 * 2/2019 ..... F03D 13/25

OTHER PUBLICATIONS

International Search Report dated Sep. 14, 2018 Issued in PCT/EP2018/061548 filed on May 4, 2018 (English translation).

* cited by examiner

OFFSHORE INSTALLATION

RELATED APPLICATIONS

This Application is a § 371 National Stage Application of PCT/EP2018/061548, filed May 4, 2018, which claims priority benefit of German Patent Application No. 102017112373.3, filed Jun. 6, 2017, which applications are incorporated entirely by reference herein for all purposes.

FIELD

The invention relates to an offshore installation comprising an underwater foundation structure, a construction placed on the foundation structure and a landing facility for a boat and a device for cathodic corrosion protection for the underwater foundation structure, having at least two anodes arranged at a distance from one another.

BACKGROUND ART

Such an offshore installation is known, for example, from EP 3 064 648 A1. The offshore installation according to the prior art comprises a jetty and a method for assembling the jetty. A corrosion protection device is provided on the jetty as an active cathodic corrosion protection with external current (ICCP). The corrosion protection device is arranged at a free end of a beam which is fastened to the jetty.

In offshore installations of the type described in EP 3 064 648 A1, corrosion protection devices are frequently either fastened to the jetty or to the transition piece between the foundation structure and the construction. Assembly takes place after the installation of the foundation structure.

The fastening of the corrosion protection devices to the transition piece or, for example, to a jetty has the disadvantage that the anodes required for the corrosion protection are often not arranged at a favorable angle to the component to be protected. If, for example, the foundation structure comprises a steel construction which is to be protected, the anodes provided for this need to be placed at such a distance from the foundation structure that the anodes cover all surfaces of the foundation structure which are to be protected. With an unfavorable arrangement of the anodes in relation to the structure to be protected, the size of the anodes must be selected accordingly.

U.S. Pat. No. 4,415,293 A describes a method for preventing marine growth on shallow water regions of platform legs by applying a polymer coating to the platform legs and coating the platform legs with an anti-growth covering made from a copper-nickel alloy.

SUMMARY OF THE INVENTION

The invention is therefore based on the object of providing an offshore installation of the type mentioned at the outset with cathodic corrosion protection which is arranged such that it realizes the most extensive protection possible for the foundation structure with a reasonable size of the anodes.

The object is achieved by the features of an offshore installation comprising an underwater foundation structure, a construction placed on the foundation structure and a landing facility for a boat and a device for cathodic corrosion protection for the underwater foundation structure, having at least two anodes arranged at a distance from one another, which are each fastened to a beam or a bracket of the foundation structure, wherein the beams or the bracket are each connected directly to the foundation structure below the waterline; advantageous configurations of the invention are revealed below.

According to one aspect of the invention, an offshore installation comprising an underwater foundation structure is provided, which comprises a construction placed on the foundation structure and a landing facility for a boat and a device for cathodic corrosion protection for the underwater foundation structure, having at least two anodes arranged at a distance from one another, which are each fastened to a beam or a bracket of the foundation structure, wherein the beams or the bracket are each connected directly to the foundation structure below the waterline.

This enables one or more anodes to be placed relatively favorably in relation to the foundation structure below the water line. In contrast to the previous solutions, it is provided according to the invention to fasten fastening means for the anodes in the form of beams or brackets directly on the foundation structure. According to the invention, it is provided to fasten these fastening means exclusively on the foundation structure.

In this case, it is particularly favorable if the underwater foundation structure is formed as a monopile foundation. In this case, the beams or the bracket can be fastened directly to the outer wall of the monopile. The beams or the bracket can be welded, screwed or riveted to the outer wall of the monopile, for example.

In particular, if a plurality of anodes are arranged distributed over the circumference of the monopile, it is possible to keep the anodes and the fastening means for these in the form of the beams or the bracket relatively small so that the monopile can be pre-equipped with the inventive cathodic corrosion protection prior to its installation in the subsoil of the seabed. The forces or dynamic loads which act on the anodes during the positioning of the monopile in the subsoil of the seabed and are caused by pile driving and/or or vibration driving are manageable as a result of the construction according to the invention.

In an advantageous embodiment of the offshore installation according to the invention, it is provided that, with reference to the circumference of the monopile, at least two anodes extend at an angular distance from one another of greater than or equal to 90°. As mentioned above, more than two anodes can be arranged distributed over the circumference of the monopile.

With reference to the circumference of the monopile, at least two anodes preferably extend at diametrically opposed points of the monopile or at diametrically opposed points of the outer wall of the monopile, so that the anodes cover the entire circumference of the monopile. It can be additionally provided that the anodes are arranged in the manner described above at a plurality of levels of the monopile below the waterline.

In a particularly preferred variant of the offshore installation according to the invention, it is provided that the beams or the bracket are each supported against the monopile by a supporting construction. The supporting construction can be formed, for example, as one or more frames welded to the outer wall of the monopile.

In an expedient variant of the offshore installation according to the invention, it is provided that the supporting construction comprises diagonal supporting struts, which each extend between the outer wall of the monopile and the beams or the bracket.

It can be alternatively provided that the supporting construction comprises gusset plates, which each extend between the outer wall of the monopile and the beams or the bracket.

The supporting struts can be formed from steel as tubes or angle profiles, for example, which each extend below and/or above the beams or the bracket, for example each at a 45° angle to the respective beam or to the bracket, which can extend at an approximate right angle to the longitudinal extent of the monopile.

The anodes can be each be formed, for example, as rods or tubes, which extend parallel to the longitudinal axis of the foundation structure or parallel to the longitudinal axis of the monopile.

Alternatively, the anodes can each be formed as a disc. An external current is expediently applied to the anodes.

A power supply or power cable to the anodes can be laid within the monopile and through the beams. The beams can be formed, for example, as hollow profiles which, in the region of openings in the outer wall of the foundation structure or in the outer wall of the monopile, are connected thereto. The beams are expediently sealed in this region with respect to the outer wall of the foundation structure or with respect to the outer wall of the monopile.

The invention furthermore relates to a method for erecting an offshore installation having one or more of the features mentioned above. The method firstly comprises pre-equipping a monopile as an underwater foundation structure with at least two beams or at least one bracket and anodes fastened thereto. The thus-prepared monopile with the anodes fastened thereto is driven into the subsoil of the seabed, for example by piling and/or vibration. After positioning the foundation structure, this can be completed accordingly, i.e. for example provided with a transition piece and a jetty and with a construction.

The construction can be designed as a tower construction of a wind turbine. However, the construction can also be formed as a platform for receiving an electrical installation or as a platform for a crude oil or natural gas production plant or a crude oil or natural gas exploration installation.

BRIEF DESCRIPTION OF THE DRAWINGS

The invention is explained below with the aid of an exemplary embodiment illustrated in the drawings, which show.

DETAILED DESCRIPTION OF THE EMBODIMENTS

Figure 1:
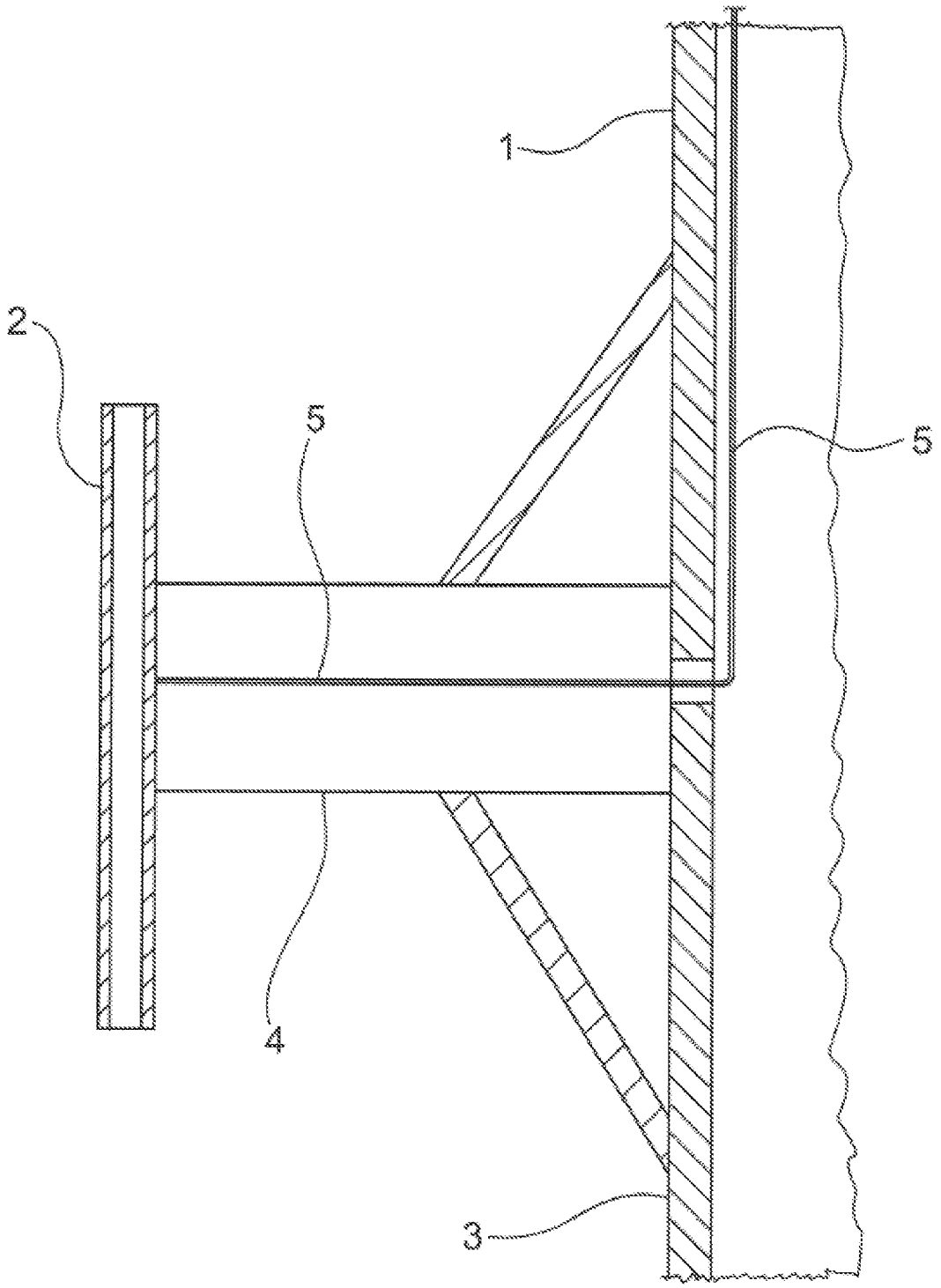
FIG. 1 a schematic view of part of the underwater foundation structure according to the invention and FIG. 2 a plan view of the foundation structure according to FIG. 1.
Figure 2:
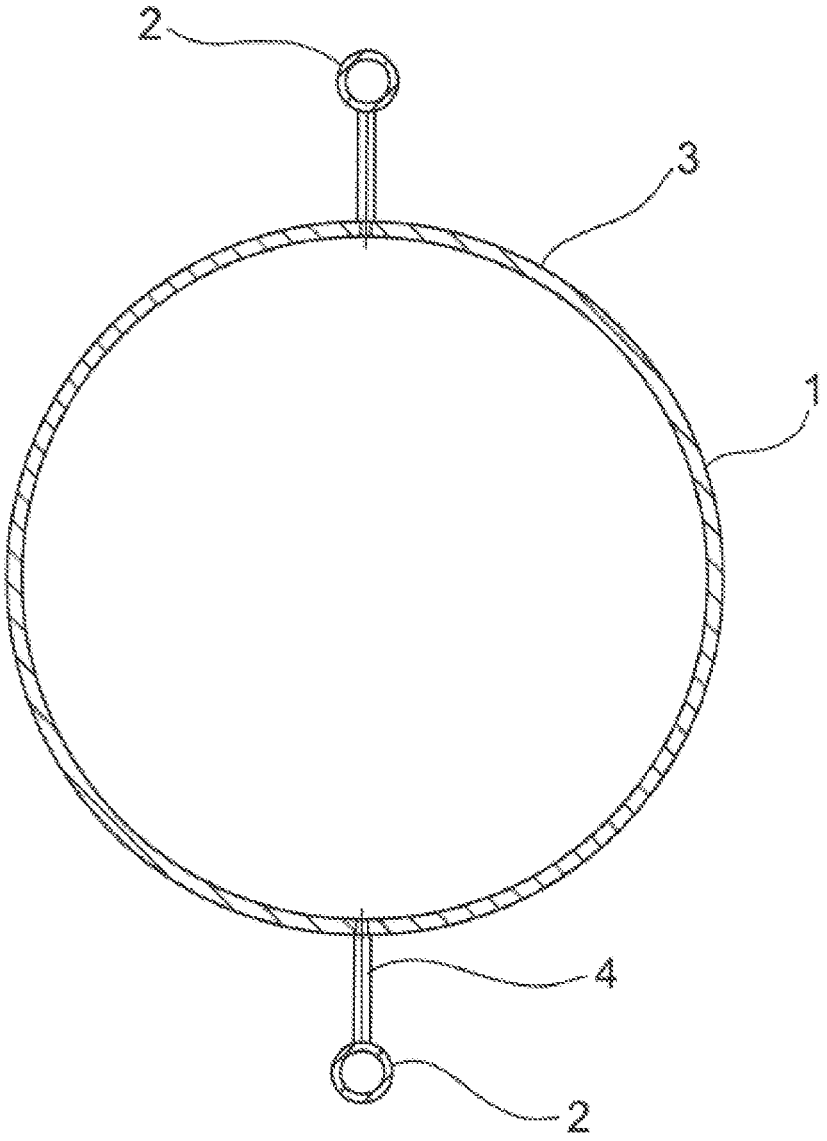

The offshore installation according to the invention comprises an underwater foundation structure in the form of a monopile 1, which has been driven into the subsoil of the seabed by vibratory piling, piling or vibration. The monopile 1 is formed, for example, as a cylindrical steel tube with a diameter of ca. 7 m, which can have been driven up to 30 m, for example, into the subsoil of the seabed. The monopile 1 comprises a flange (not illustrated) on which a transition piece is placed. The transition piece in turn receives a construction, for example a platform for a transformer facility or for a production or exploration facility or a tower for a wind turbine.

The offshore installation according to the invention can furthermore comprise a boat landing facility, which, for example as a steel tube construction, can be fastened both to the transition piece and to the monopile 1.

The offshore installation furthermore comprises a device for cathodic corrosion protection, which is operated by an external current (ICCP). In the exemplary embodiment described, the corrosion protection device comprises two anodes 2, which are fastened at diametrically opposed points of the monopile 1 to the outer wall 3 thereof. The anodes 2 are each formed as tubular elements, which are fastened to beams 4 on the monopile 1. The anodes extend approximately parallel to the longitudinal axis of the monopile 1. They can also extend at an angle to the longitudinal axis of the monopile 1. As already described above, the anodes can also be formed in a disc shape. It is essentially possible for more than 2 anodes to be arranged distributed over the circumference of the monopile 1.

The beams 4 are formed as steel girders, which are welded to the outer wall 3 of the monopile 1.

The beams 4 are formed as hollow profiles through which a power cable 5 is laid. The power cable 5 is connected to the anode 2 and is guided through an opening 8 in the outer wall 3 of the monopile 1 to a voltage source (not illustrated). The beam 4 is connected in a sealed manner to the outer wall 3 of the monopile 1 so that seawater cannot penetrate into the monopile 1.

The beam 4 is supported against the outer wall 3 of the monopile 1 by means of a supporting construction. The supporting construction comprises a first lower supporting strut 6 and a second upper supporting strut 7.

The first lower supporting strut 6 extends diagonally between the beam 4 and the outer wall 3 of the monopile 1. This is welded at one end to the underside of the beam 4 and at the other end to the outer wall 3 of the monopile 1.

The second upper supporting strut 7 extends diagonally between the beam 4 and the outer wall 3 of the monopile 1. This is welded at one end to the upper side of the beam 4 and at the other end to the outer wall 3 of the monopile.

The first lower supporting strut 6 and the second upper supporting strut 7 can also be formed as angle profiles, as rods or as tubes. These can be formed as solid profiles or as hollow profiles.

The spaces formed in each case between the supporting struts 6, 7 can be filled. For example a gusset plate can be inserted therein.

The beams 4 and the supporting struts 6, 7 do not essentially have to be made from metal; they can, for example, alternatively be made from a fiber-reinforced plastics material, from carbon fiber or another light plastics material. In this case, the beams and the supporting struts 6, 7 can be screwed to the outer wall 3 of the monopile 1.

In the exemplary embodiment described, the anodes 2 or the beams 4 each extend on the outer wall 3 of the monopile at an angular distance from one another of 180°. According to the invention, the angle between the anodes 2 or beams 4 can be greater than or equal to 90° and smaller than or equal to 180° if only two anodes 2 are provided. If more than two anodes 2 are provided, the angle between the individual anodes 2 can be smaller than or equal to 90°.

LIST OF REFERENCE SIGNS

1 Monopile
2 Anode
3 Outer wall of the monopile
4 Beam

5 Power cable
6 First lower supporting strut
7 Second upper supporting strut
8 Opening

The invention claimed is:

1. An offshore installation comprising an underwater foundation structure, a construction placed on the foundation structure and a landing facility for a boat and a device for cathodic corrosion protection for the underwater foundation structure, having at least two anodes (2) arranged at a distance from one another, which are each fastened to one of a plurality of a beams (4) or brackets of the foundation structure, wherein the offshore installation is characterized in that the beams or the bracket are each connected directly to the foundation structure below a waterline;

the underwater foundation structure is formed as a monopile foundation and the beams (4) or the bracket are fastened directly to an outer wall of a monopile (1); and with reference to a circumference of the monopile (1), the at least two anodes (2) extend at an angular distance from one another of greater than or equal to 90°; and the beams are formed as hollow profiles through which a power cable is laid, the power cable being connected to the anode and being guided through an opening in the outer wall of the monopile.

2. The offshore installation of claim 1, wherein with reference to the circumference of the monopile (1), the at least two anodes (2) extend at diametrically opposed points of the monopile (1).

3. The offshore installation of claim 1, wherein the beams (4) or the bracket are each supported against the monopile (1) by a supporting construction.

4. The offshore installation as claimed of claim 3, wherein the supporting construction comprises diagonal supporting struts (6, 7), which each extends between the outer wall (3) of the monopile (1) and the beams (4) or the bracket.

5. The offshore installation of claim 1, wherein the anodes (2) are each formed as rods or tubes which extend approximately parallel to a longitudinal axis of the foundation structure.

6. The offshore installation of claim 1, wherein the anodes (2) are each formed as a disc.

7. The offshore installation of claim 1, wherein an external current is applied to each of the anodes (2).

8. The offshore installation of claim 1, wherein the beams or the bracket are welded, screwed or riveted to the outer wall of the monopile.

9. A method for erecting an offshore installation having the features of claim 1, in which a monopile (1) as an underwater foundation structure is firstly pre-equipped with at least two beams (4) and anodes (4) fastened thereto, the monopile (1) with the anodes (2) fastened thereto is then driven into a subsoil of a seabed and the construction to be erected is subsequently assembled and completed.

* * * * *